United States Patent [19]

Holshouser et al.

[11] 3,958,248

[45] May 18, 1976

[54] TUNABLE DIPOLE ANTENNA FOR TELEVISION RECEIVERS

[76] Inventors: Howard E. Holshouser, 1472 Moores Point Road, Suffolk, Va. 22436; Julius Kemeny, 2917 Harbor Road, Suffolk, Va. 23435

[22] Filed: Jan. 30, 1975

[21] Appl. No.: 545,308

[52] U.S. Cl. ..... 343/803; 343/818; 343/823

[51] Int. Cl.[2] ..... H01Q 9/14

[58] Field of Search ..... 343/723, 823, 803, 818

[56] References Cited

UNITED STATES PATENTS

| | | | |
|---|---|---|---|
| 2,476,469 | 7/1949 | Walker | 343/823 |
| 2,492,989 | 1/1950 | Halstead | 343/823 |
| 2,558,145 | 6/1951 | Mock | 343/823 |
| 3,163,863 | 12/1964 | Fujino | 343/823 |

*Primary Examiner*—Eli Lieberman

[57] ABSTRACT

A dipole antenna adjustable in span and distance to the reflector provides higher gain reception for a television receiver. By maintaining the ratio of span to distance constant optimum tuning is possible over a given band of frequencies. Tuning adjustment control is obtained from behind the reflector to eliminate interference with the radiation pattern of the antenna.

10 Claims, 8 Drawing Figures

TUNABLE DIPOLE ANTENNA FOR TELEVISION RECEIVERS

BACKGROUND OF THE INVENTION

The present invention relates to tunable communication antennas and more specifically to a directional antenna tunable over the UHF band of television frequencies.

More and more in recent times VHF channels for television broadcasting in many areas of the country has become limited and the need has greatly increased for UHF channel utilization. Broadcasting in the UHF band, however, presents the problem of greater transmission path loss and higher gain antenna systems are required. Where high quality outside antennas are utilized in the reception of the broadcasted television signals, these conditions of increased channel utilization presents little or no problem. However, for television reception where indoor antennas are relied upon such as, for example, with portable receivers, the normal loop UHF antenna has been found to be inadequate. This is due in part to two factors. The first is that the loop antenna lacks directivity. The second factor is that this antenna is relatively broad band in its receiving characteristic thus being a compromise presenting less than optimum gain for the various channels in the UHF band.

It is accordingly an object of the present invention to provide an improved UHF antenna for television receivers capable of portable and indoor use.

Another object of the present invention is to provide a directional antenna that is tunable over a band of frequencies to provide higher gain communication.

Another object of the present invention is to provide a dipole antenna with reflector that is tunable by simultaneous adjustment of dipole span and distance from the reflector.

A further object is to provide a tunable dipole antenna tunable from behind the reflector to avoid interference with the radiation characteristics during tuning.

BRIEF SUMMARY OF THE INVENTION

These and other objects are realized by providing an antenna which includes a dipole or folded dipole adjustably supported parallel to the plane of the reflector. The span of the dipole is selected to be a half wave length at one of the frequencies in the band over which tuning is desired, e.g., the UHF band, and the distance of the dipole from the reflector is selected to be one quarter wave length. Dipole span and distance adjusting means are coupled to the dipole to change the span and distance of the dipole to the reflector simultaneously maintaining the ratio of span to distance constant throughout the band. The adjusting means may extend through the reflector to be actuated behind the reflector thereby avoiding interference with the radiation pattern during tuning.

BRIEF DESCRIPTION OF THE DRAWINGS

A better understanding of the invention, its features and objects may be obtained from the following detailed description taken in conjunction with the drawings, in which.

DETAILED DESCRIPTION

Figure 1:
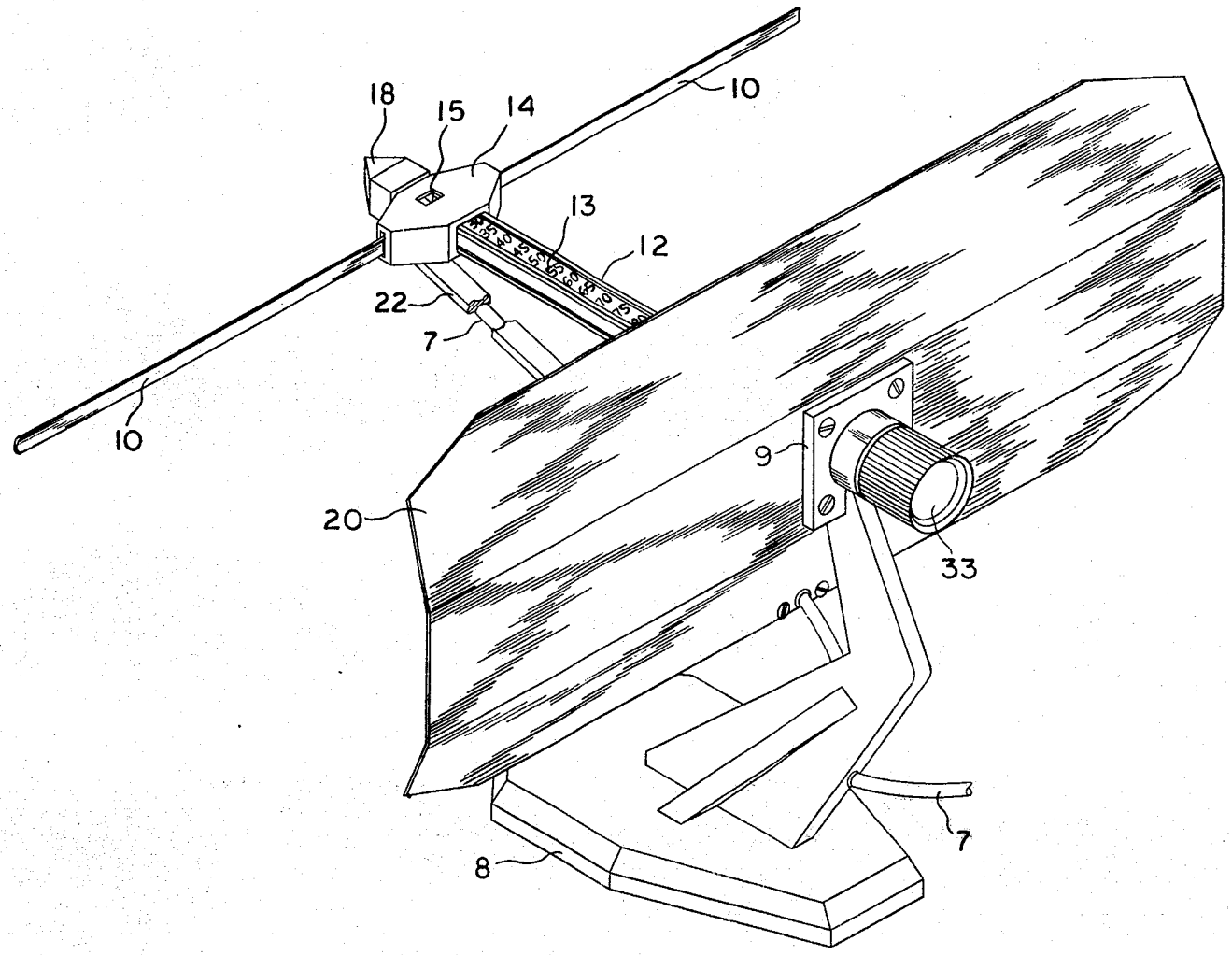
FIG. 1 is an overall perspective view of a preferred embodiment of the present invention.

FIG. 1 shows a perspective view of a preferred embodiment of the invention viewed from the rear and top of the antenna. The antenna is shown mounted on a stand 8 which supports a sheet reflector 20 of predetermined geometric shape by means of a securing bracket 9 fastened to the reflector such as by screws. A support column 12 is shown which in conjunction with supporting stay device 22 supports a dipole antenna element including a carrier 14 which is slideably supported on the column 12 and the dipole 10. Dipole 10 is made up of resilient spring like strip metal which lies along the support column 12 except for the portion bent out by the carrier 14. The stay 22 may be used to couple the antenna lead 7 to the dipole 10. Support column 12 may be secured at its near end to the reflector such as by a securing flange much the same as the stand is secured by securing flange 9. Alternatively or in addition, the support column 12 can be supported by additional stays 22 each fastened at the end cap 18 of the support column so as to be free at the near end of the support column in order to accommodate different adjust mechanisms. The end caps 18 also serves to arrest movement of carrier 14 at the lowest channel 14 in the band.

FIG. 1 also shows that the support column 12 may be calibrated to indicate by channel designation numbers 13 what channel the antenna is nominally tuned to. These channel indicating numbers are viewed through window 15 in the carrier 14.

Figure 3:
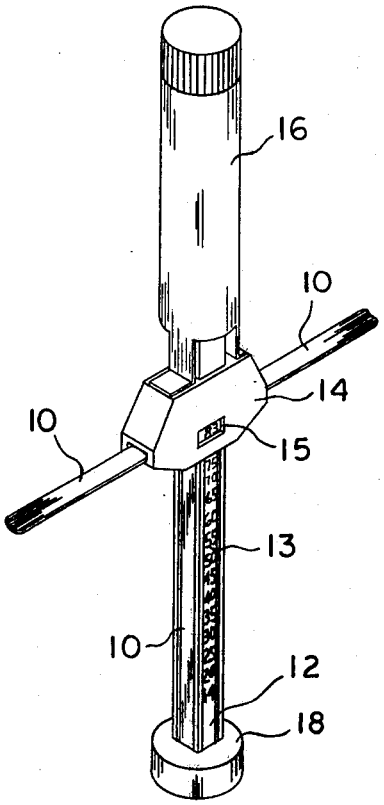
FIG. 3 is a perspective view of one embodiment of the antenna span and distance adjusting mechanism.
Figure 2:
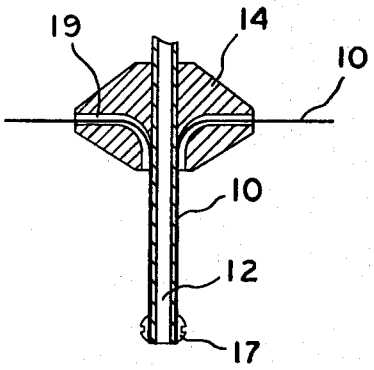
FIG. 2 is a detail view of the carrier employed in the embodiments of FIGS. 1, 3, 4 and 5.

In FIG. 2 a detail of the internal construction of the carrier 14 is shown. The carrier 14 is shown to include cam acting slot 19 which receives the metal strip 10 and causes it to bend 90 degrees from its normal position alongside the support column 12. FIG. 3 also shows that at the far end of the support column means 17 are provided not only to secure the metal strip 10 to each side of the support column but also to electrically connect the cable 7 shown in FIG. 1 to the strips 10 of the dipole.

Referring now to FIG. 3 there is shown a first type of actuating mechanism including the carrier 14 of the embodiment of FIG. 1. In FIG. 3 the carrier 14 is shown being integral with a push rod 16 and the entire unit being integral with a push rod 16 and the entire unit being telescopically coupled to the support member 12. Although not shown, the push rod 16 is intended to pass through the reflector and be accessible from the rear so that the movement of the carrier 14 is possible without interfering with the radiation pattern of the antenna. It is noted that in FIG. 1 the carrier is in the channel 14 position with the dipole fully extended, the carrier resting against the stop 18. Whereas in FIG. 3 the carrier is in the channel 83 position and the dipole span is shortest. It is recognized and intended as part of the present invention that once the optimum span of the dipole 10 is determined for one frequency and the optimum distance of the dipole to the reflector is determined for that same frequency, the ratio realized between span and distance should be maintained constant for each of the frequencies within the UHF band. Thus, in each of the FIGS. 1 and 3 the span of the dipole is a half wave length at the frequency of the channel and the distance of the dipole to the reflector is a quarter wave length. Both the shape of the support column 12 and the carrier 14 with its internal cams are selected to keep the ratio between span and distance constant throughout the UHF band.

Figure 4:
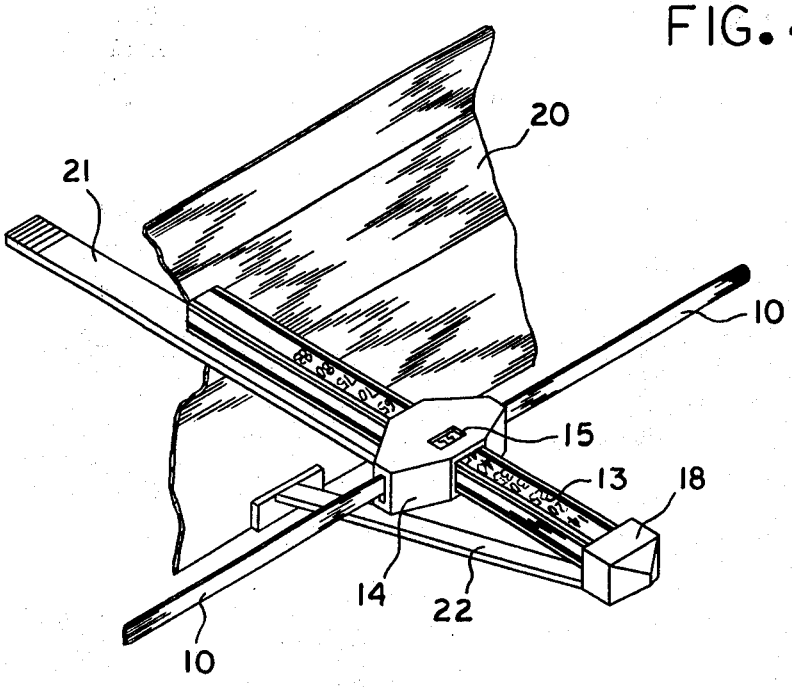
FIG. 4 is a perspective view of an alternative embodiment of the adjusting mechanism.

Referring now to FIG. 4, an alternative push rod mechanism 21 is shown located between supporting stay 22 and the support column 12 and independent from the support column. As shown, the push bar 21 passes through the reflector 20 and is accessible to the operator from the rear of the reflector. The push rod 21 is secured to carrier 14 to form an alternate embodiment of the adjusting or tuning mechanism for the embodiment of the invention employing the resilient spring metal dipole 10.

Figure 5:
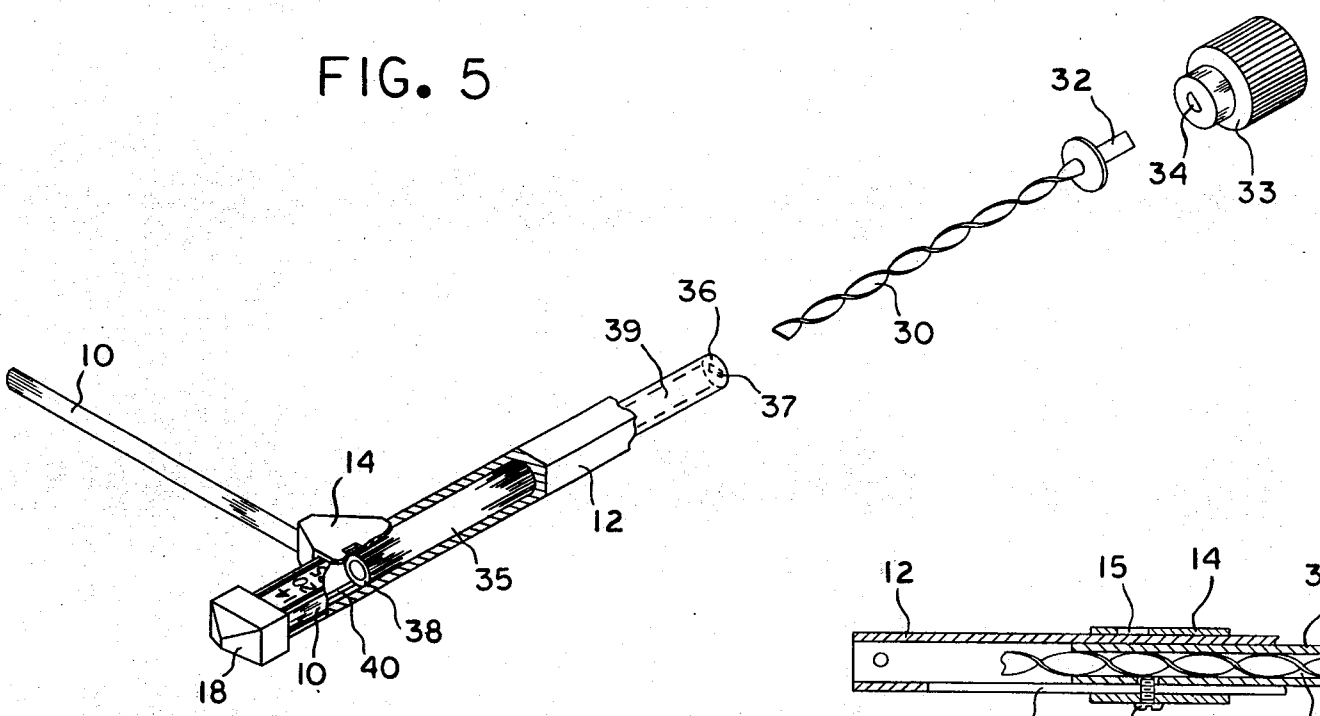
FIG. 5 is a break away view showing details of another embodiment of the adjusting mechanism.
Figure 6:
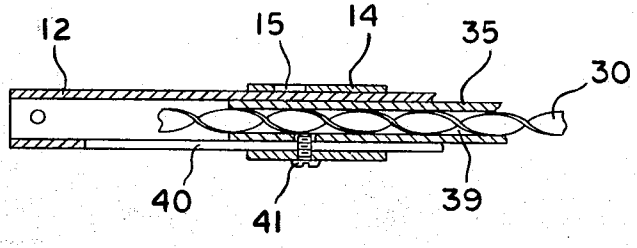
FIG. 6 is a detail of the carrier used in the embodiment of the adjusting mechanism shown in FIG. 5.

FIG. 5 shows still another mechanism for adjusting the span and distance of the dipole to the reflector. Here the support column 12 is cut away to show the antenna adjusting mechanism contained therein. This mechanism includes a control device in the form of knob 33, coupled to screw drive means 30 which engages the slot 37 at end 36 of drive cylinder 35. The drive cylinder 35 is slideably retained within column 12. As shown more fully in FIG. 6, the drive cylinder 35 is connected directly to the carrier by means of a slot pin in the form of a screw 41. The screw passes through a slot 40 in the bottom surface of column 12. The slot pin 41 thus keeps drive cylinder 35 from turning but permits sliding movement of both the drive cylinder and the carrier as the screw drive means 30 advances or retreats within the chamber 39 in the drive cylinder 35. Thus, as the drive cylinder slides along within support column 12 the carrier 14 rides with it spreading or retracting the dipole 10.

Figure 7:
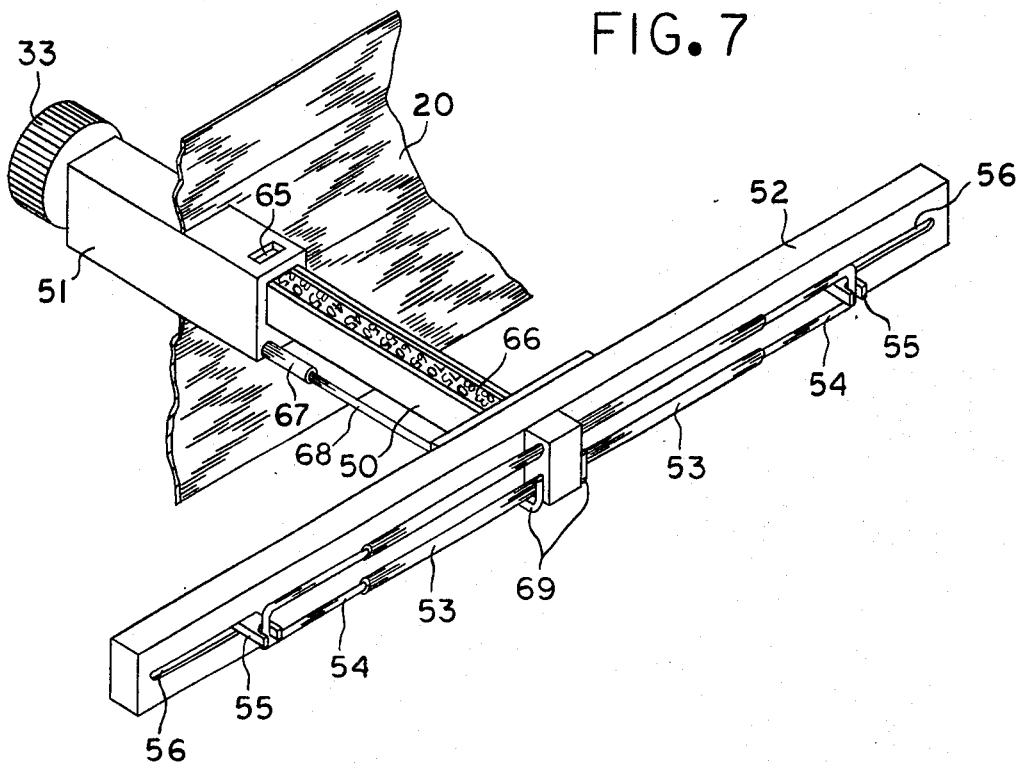
FIG. 7 is a perspective view of another embodiment of the present invention employing a folded dipole.
Figure 8:
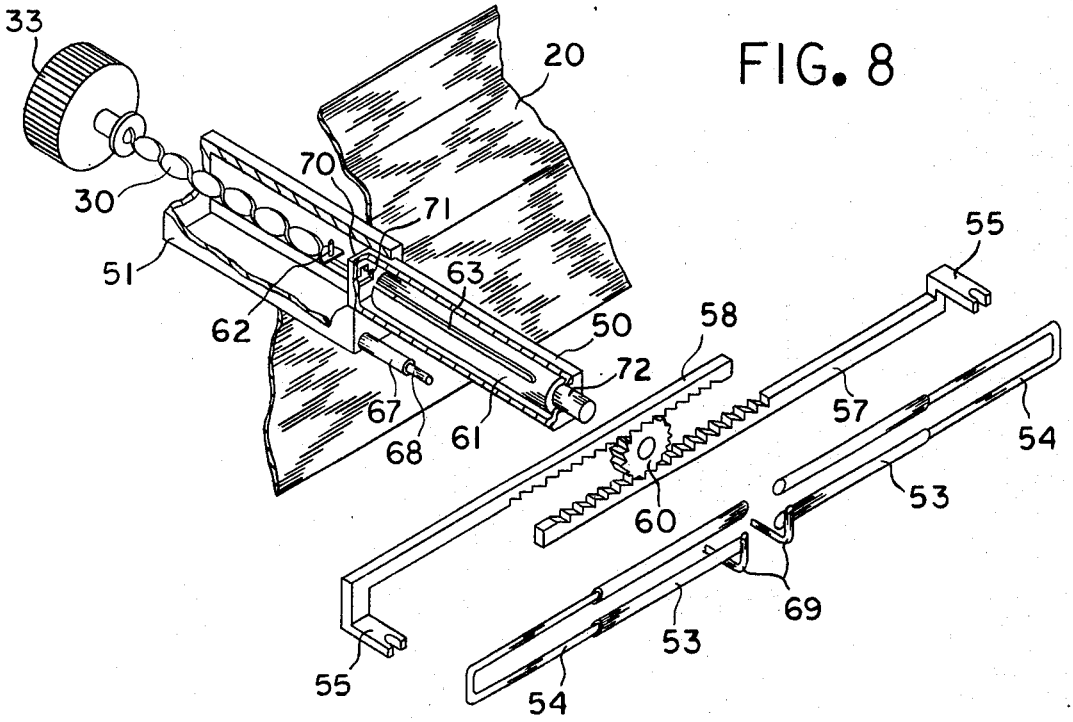
FIG. 8 is a break away view of the antenna shown in FIG. 7 showing the details of the adjusting mechanism.

FIGS. 7 and 8 show another embodiment of the present invention. Here the support column 12 is replaced by extendable support means including a first element 51 rigidly affixed to the reflector 20 and a telescoping column 50 which supports a perpendicular support structure 52. Support structure 52 in turn supports a folded dipole antenna made up of telescoping elements 53 and 54. Support element 52 contains slots 56 through which part of the adjust mechanism 55 passes to engage the portion 54 of the folded dipole so that a change in the span of the dipole can be effected. Support element 51 includes a window 65 for viewing channel indicating indicia 66 on telescoping column 50, again to provide channel tuning indication.

FIG. 8 shows the same elements cut away to reveal details of the span and distance adjust mechanism. It should be understood that while a screw drive type mechanism is again shown for this folded dipole embodiment, various combinations of other advancing mechanisms such as the push rod devices shown in FIGS. 2 and 4 could also be employed. Knob 33, adjacent to and accessible from behind reflector 20 again engages a screw drive means 30 which in turn drives telescoping column 50 and drive cylinder 61 contained therein. The end 70 of column 50 contains a T-slot 71 having a horizontal opening to receive screw drive means 30. Passage of the screw drive means through the horizontal slot causes column 50 to slideably advance or retreat in support element 51. The vertical portion of the T-slot 71 enables drive pin 62 to pass and enter into engagement with slot 63 in drive cylinder 61. Drive cylinder 61 is entrapped within column 50 so that it slideably moves therewith but is free to revolve therein. Revolving movement of cylinder 61 causes pinion 60 to rotate by means of shaft 72. Rotation of pinion 60 in turn causes the racks 57 and 58 to move either apart or together depending upon the direction of rotation. Attached to the racks 57 and 58 are the extensions 55 which engage the portions 54 of the folded dipole antenna element.

It is recognized that by proper proportioning of the pitch of the screw drive means and the teeth in the pinion 60 and in the racks 57 and 58, the desired proportionality between the span of the dipole and its distance from the reflector can be maintained.

FIGS. 7 and 8 also show the utilization of telescoping antenna lead means 67 and 68. These elements, much like elements 53 and 54 of the folded dipole, telescope to provide an extendable length lead in accordance with the distance of the folded dipole to the reflector 20. The antenna lead is shown being connected to the dipole element at points 69.

It will become apparent from the foregoing to those skilled in the art that many alternatives to the embodiments shown are possible. It is intended that the foregoing description serve not in limitation but in exemplification of the principles and alternatives of the invention and that all such alternatives and the scope of this invention be determined only by the appended claims.

What is claimed and desired to be secured by Letters Patent of the United States is:

1. A directional antenna tunable over a band of frequencies comprising:

a sheet reflector, said sheet reflector being of predetermined geometric shape, dipole means of adjustable span, support means for adjustably supporting said dipole means in operative relationship wih said reflector, and with adjust means coupled to said dipole means and operable to simultaneously adjust the span of said dipole means and the distance between said dipole means and said reflector to maintain a tuned relationship between said dipole means and said reflector for each of the frequencies in said band, said adjust means including control means immediately adjacent to and accessible from behind said reflector to enable tuning of said antenna without affecting the radiation characteristics thereof.

2. The directional antenna recited in claim 1 wherein said adjust means in the course of tuning said antenna maintains a substantially constant ratio between said span and said distance.

3. The directional antenna recited in claim 2 wherein said dipole means is selected to have a half wave length span and a quarter wave length distance to said reflector, and said adjust means substantially maintains throughout the tuning range the half wave length span and quarter wave length distance for each of the frequencies in said band.

4. The directional antenna recited in claim 1 wherein said dipole means includes resilient strip metal a portion of which lies along said support means, and carrier means movable along said support means to separate said strip metal into a dipole parallel to the plane of said reflector.

5. The directional antenna recited in claim 4 wherein said support means lies perpendicular to the plane of said reflector and said adjust means comprises a push bar coupled to said carrier to enable said carrier to be drawn toward and pushed away from said reflector, said push bar extending through said reflector to enable tuning of said antenna without affecting the radiation characteristics thereof, said support means being calibrated to indicate desired points of position for said carrier at each of the frequencies within said band, the shape of said support means and carrier being such that the ratio of said span to said distance is maintained substantially constant throughout the tuning range.

6. The directional antenna recited in claim 5 wherein said carrier and said push bar comprise a single structure telescopically coupled with said support means, such that as said carrier and push bar structure is moved said support means telescopes therein.

7. The directional antenna recited in claim 4 wherein said adjust means includes screw drive means and said carrier means includes means to receive said screw drive means such that as said screw drive means revolve said carrier means is caused to move along said support means.

8. The directional antenna recited in claim 7 wherein said adjust means includes control means accessible from behind said reflector and coupled to said screw drive means to enable said screw drive means to revolve thereby tuning said antenna without affecting the radiation characteristics thereof.

9. The directional antenna recited in claim 1 wherein said dipole means includes a telescoping folded dipole, said support means includes extendable support means enabling said adjust means to adjust the span by telescoping said folded dipole and to simultaneously adjust the distance of said folded dipole from said reflector.

10. The directional antenna recited in claim 9 wherein said adjust means includes screw drive means in engagement with said extendable support means to move said folded dipole relative to said reflector, and rack and pinion means coupled to portions of said folded dipole to cause said folded dipole to telescope upon operation of said rack and pinion means, said rack and pinion means and said screw drive means being linked in operative relationship such that activation of said adjust means causes simultaneous movement of said folded dipole in span and distance from said reflector.

* * * * *